US006507959B1

(12) United States Patent
Sundberg et al.

(10) Patent No.: US 6,507,959 B1
(45) Date of Patent: Jan. 21, 2003

(54) BATH STATION

(75) Inventors: Brian Sundberg, Chester, NH (US); Jorge Tomas, Wrentham, MA (US); Allan Ferraro, Sr., Attleboro, MA (US); Steven Torosian, Lee, NH (US); Steven Gibree, Hope, RI (US); Steven Belisle, Bristol, RI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/596,830

(22) Filed: Jun. 19, 2000

(51) Int. Cl.[7] ..... A47K 3/024
(52) U.S. Cl. ..... 4/572.1; 4/584
(58) Field of Search ..... 4/572.1, 584, 578.1, 4/546, 548, 538

(56) References Cited

U.S. PATENT DOCUMENTS

| | | | | | |
|---|---|---|---|---|---|
| 2,237,177 | A | * | 4/1941 | Fischer | 4/572.1 |
| 2,503,938 | A | * | 4/1950 | Davis | 4/572.1 |
| 2,504,287 | A | | 4/1950 | Ward | |
| 3,022,518 | A | * | 2/1962 | Hayden | 4/560.1 |
| 3,031,229 | A | | 4/1962 | Symbaluk | |
| 3,995,331 | A | | 12/1976 | Fotre et al. | |
| 4,234,978 | A | | 11/1980 | Snow | |
| 5,158,460 | A | | 10/1992 | Bernstein et al. | |
| 5,181,284 | A | | 1/1993 | Raphael et al. | |
| 5,276,926 | A | | 1/1994 | Lopez | |
| 5,425,149 | A | | 6/1995 | Crossley et al. | |
| 5,588,159 | A | | 12/1996 | Poulson et al. | |

FOREIGN PATENT DOCUMENTS

| | | | | |
|---|---|---|---|---|
| DE | 120817 | * | 8/1930 | 4/548 |
| GB | 165933 | * | 6/1921 | 4/559 |
| GB | 848474 | * | 9/1960 | 4/572.1 |
| GB | 1018639 | * | 1/1966 | 4/573.1 |

* cited by examiner

*Primary Examiner*—Charles E. Phillips
(74) *Attorney, Agent, or Firm*—Barnes & Thornburg

(57) ABSTRACT

A small child's bath station that provides support for a child during bathing. The bath station collapses to a smaller volume for storage and transport. The bath station includes at least two tub sections having an operative position defining a bath tub with a bath cavity and an inoperative position wherein the volume of the bath cavity is reduced for storage and transportation. The bath station may also include a bath ring assembly moveable between an inoperative position and an operative position for providing support to a child in a sitting position within the bath cavity.

68 Claims, 16 Drawing Sheets

BATH STATION

FIELD OF THE INVENTION

The present invention relates to a bath station for a small child and more particularly to a bath station that provides support for a child during bathing and collapses to a smaller volume for storage and transport.

BACKGROUND OF THE INVENTION

In the past, bathing tubs have been sized appropriately to fit a small child as well as provide additional support to the child. However, any additional support provided usually supports the child in a reclining or a supine position and does not provide support while the child is in a sitting or upright position other than a simple back rest. Furthermore, these tubs do not collapse the size of the bath cavity. As a result, these baby tubs are difficult to store because of the large storage volume area of the bath cavity and also do not provide any frontal support to a sitting child.

SUMMARY OF THE INVENTION

The present invention is therefore directed to an apparatus for a small child bath station which overcomes the above-noted and other disadvantages of prior bathing tubs. The present invention has a bathing compartment constructed of a pair of tub sections, each section having a bottom wall and a side wall with the side wall extending about three sides of the bottom wall. The tub sections are attached through latching means to releasably lock the sections together to form a waterproof seal and when released, enables the two sections to collapse together to reduce its storage volume. The bath station may also have a support ring mounted to one of the tub sections. The support ring is movable to an operative position to support a child in a sitting position within the tub compartment. The support ring also may be moved to an inoperative position out of the way of the bath tub compartment to provide room in the bath tub compartment for a child in a reclined position or for a child able to support himself or herself in a sitting position.

Various embodiments of the present invention provide certain advantages and overcome certain drawbacks of prior devices and systems. Embodiments of the invention may not share the same advantages, and those that do, may not share them under all circumstances. This being said, the present invention provides numerous advantages including the noted advantage of reducing storage area and augmenting support of a child in a sitting position.

Further features and advantages of the present invention as well as the structure and method of making various embodiments of the present invention are described in detail below with reference to the accompanying drawings.

BRIEF DESCRIPTION OF THE DRAWINGS

Various embodiments of the invention will now be described, by way of example, with reference to the accompanying drawings, in which.

DETAILED DESCRIPTION

The present invention is directed to a bath station having an expanded, operative position and a collapsed, storage position. The apparatus may also include a bath ring assembly having an inoperative position and an operative position for support of a child in a sitting position within the bath compartment.

Figure 1:
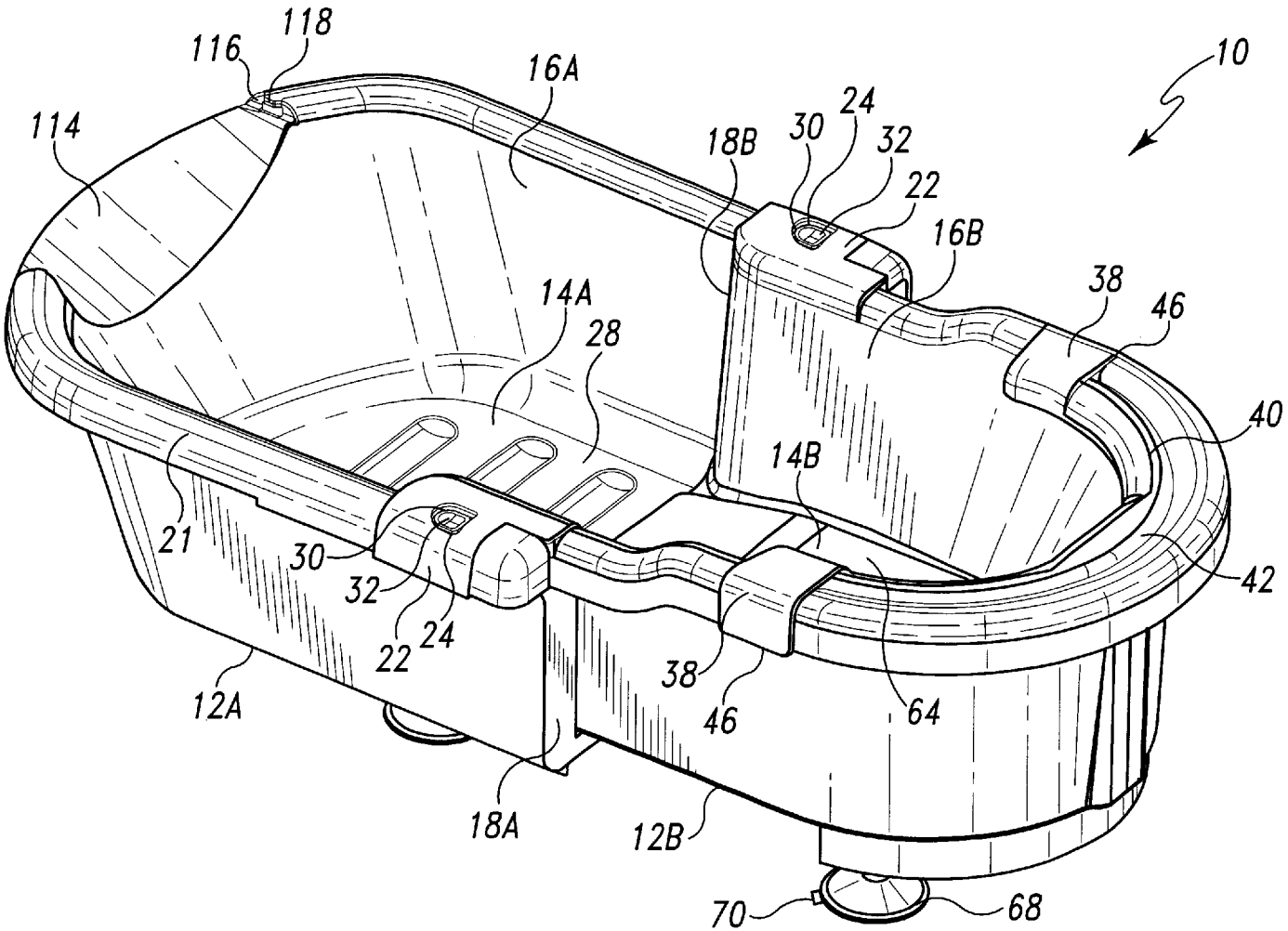
FIG. 1 is a perspective view of an embodiment of the invention in the operative and expanded position.

FIG. 1 illustrates one embodiment of a bath station 10 in an operative, expanded position for bathing. The bath station has two sections 12A, 12B, shown separately in an alternative embodiment in FIG. 12. Each section 12A, 12B includes a bottom wall 14A, 14B that is fixably attached to side wall 16A, 16B which forms a waterproof wall around three sides of the bottom wall 14A, 14B.

Figure 2:
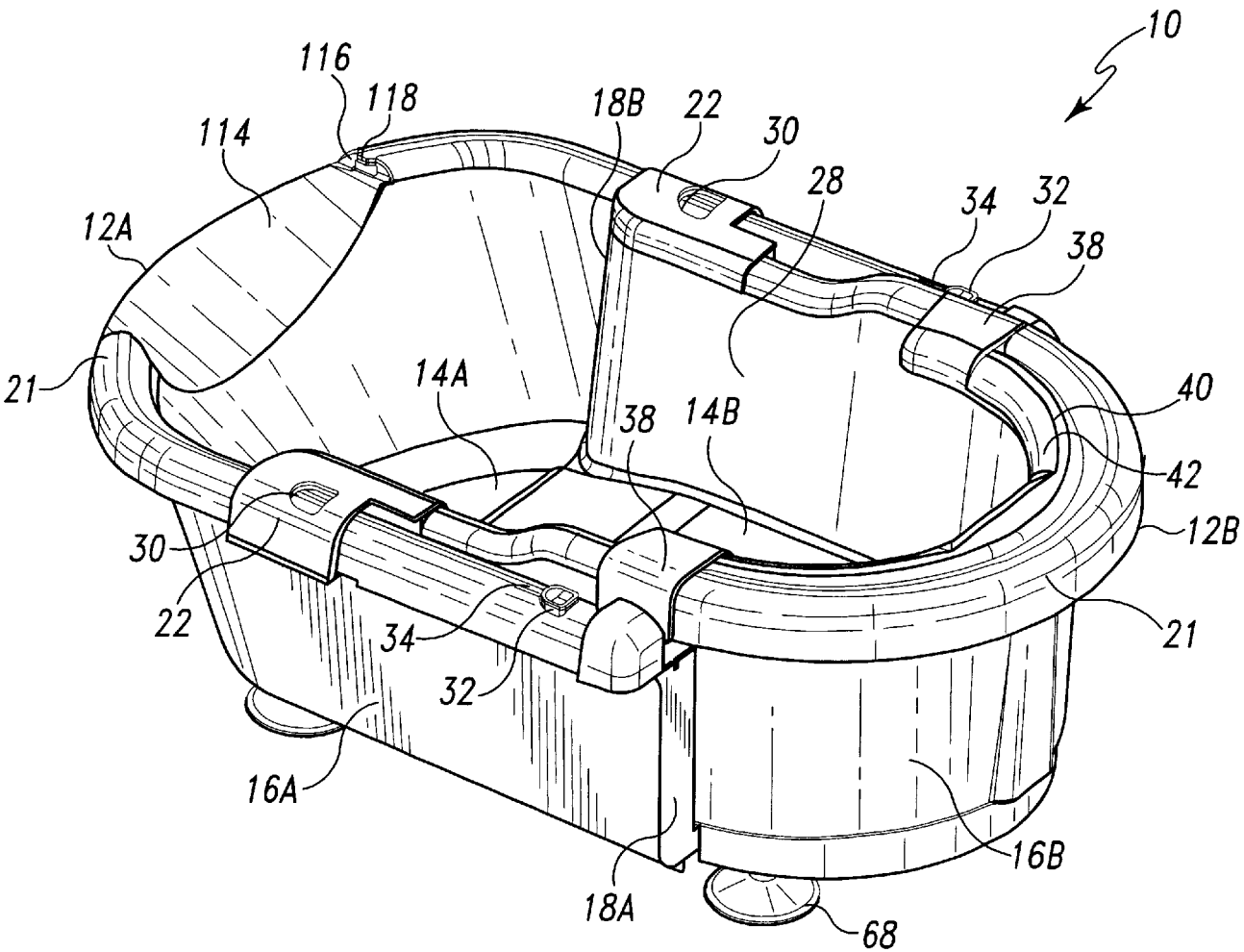
FIG. 2 is a perspective view of an embodiment of the invention collapsed for storage.

In the inoperative and collapsed position of bath station 10, as shown in FIG. 2, section 12B and flange 18B may be shaped and sized to fit inside or telescope into the bottom side 14A and side wall 16A of section 12A. Although the invention is shown and described having section 12B shaped and sized to telescope into section 12A, the invention is not limited in this respect and either section 12A, 12B may fit inside of the opposite section in the collapsed position, as long as the two sides may be collapsed to reduce the storage volume of bath cavity 28, including, but not limited to, telescoping, separating and nesting, and folding.

In the operative and expanded position, sections 12A, 12B may be mated together at the open end 13A of section 12A and the open end 13B of section 12B to form a bathing cavity 28. To form a waterproof seal between sections 12A, 12B, the two sections 12A, 12B may be expanded apart and mated together to engage a sealing mechanism 20 (see FIG. 12).

Figure 4:
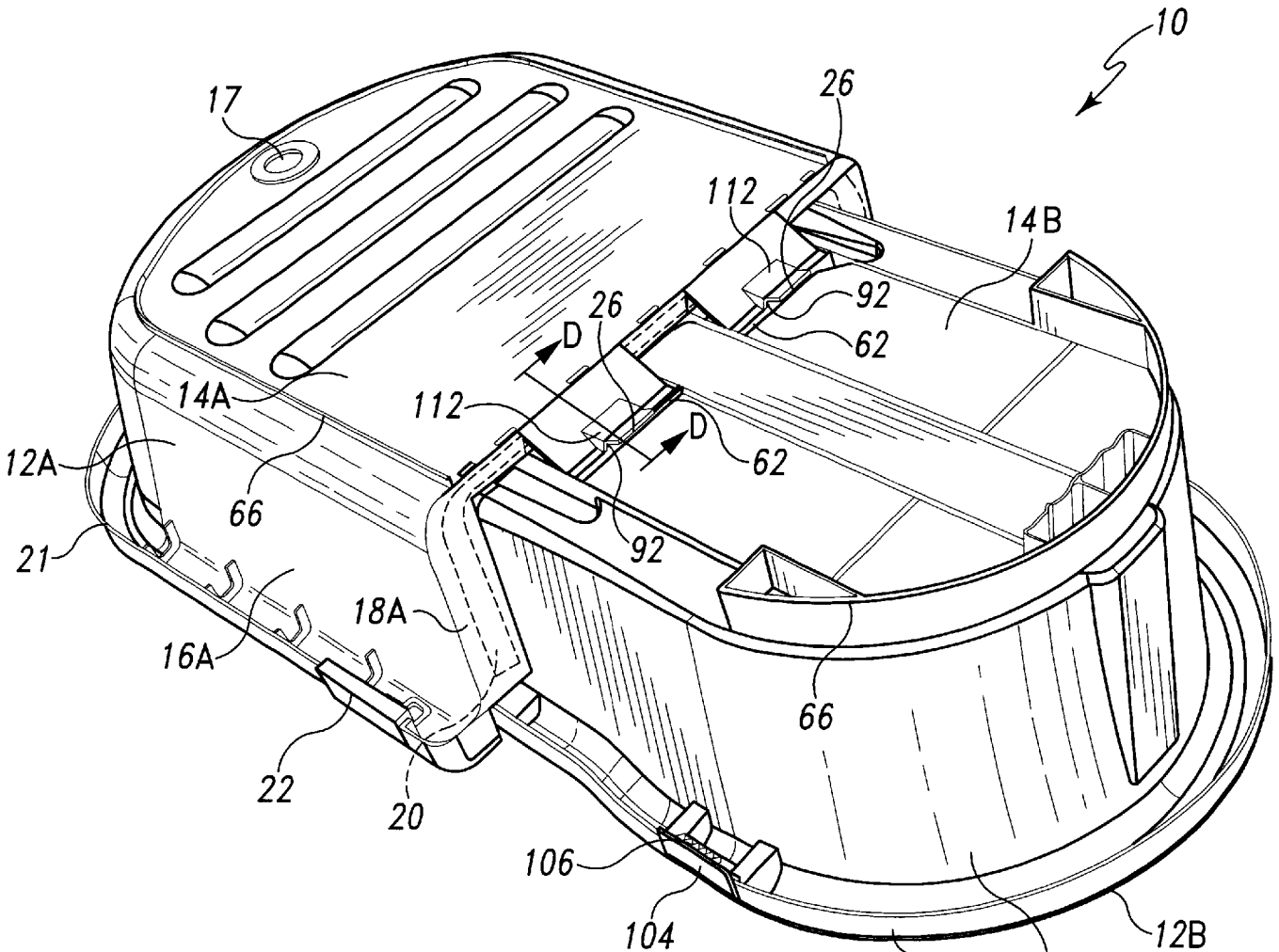
FIG. 4 is a bottom, perspective view of an embodiment of the invention in the operative, expanded, and locked position.
Figure 7:
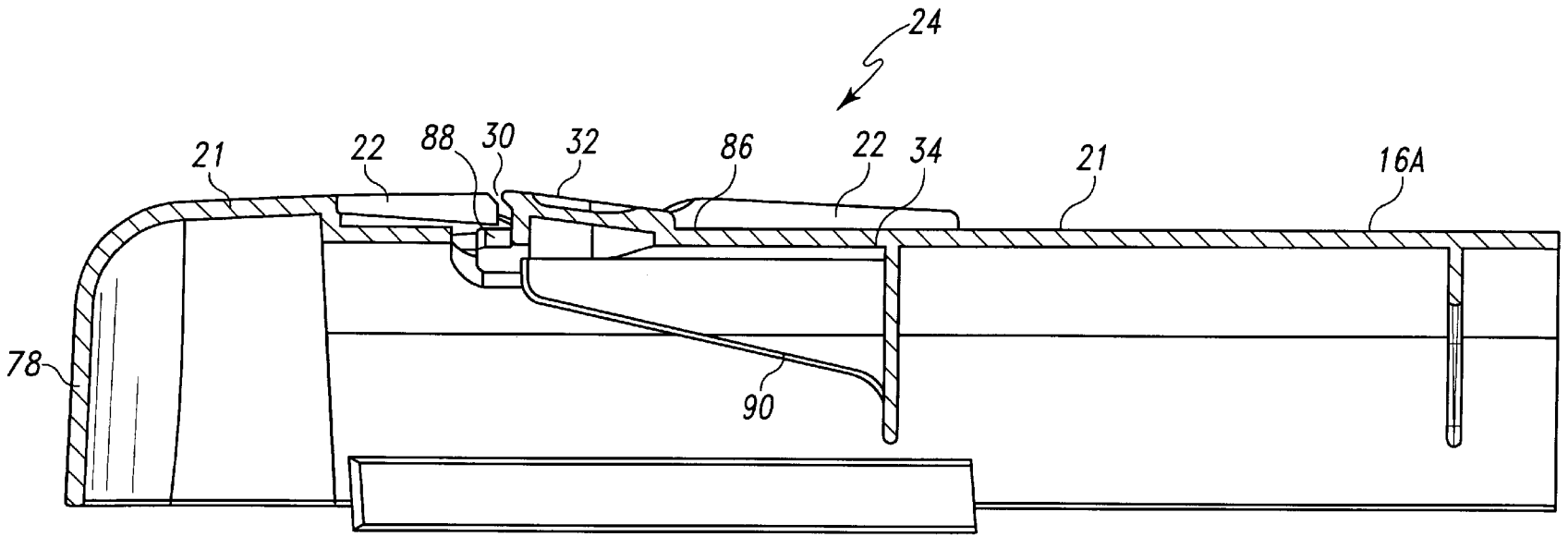
FIG. 7 is a cross sectional view at section lines A—A in FIG. 11 of an embodiment of a locking mechanism of the invention and a mounting bracket.
Figure 9:
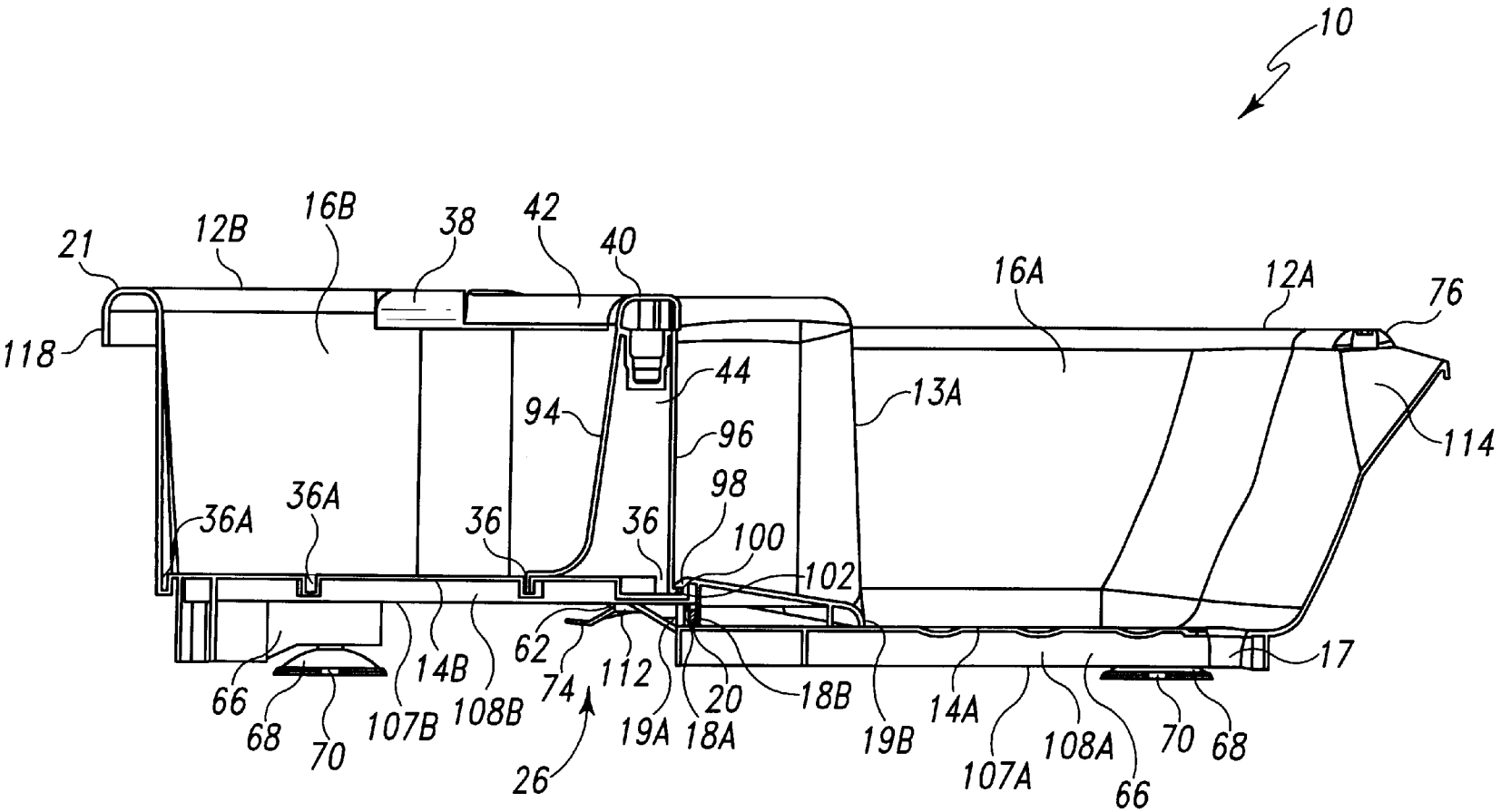
FIG. 9 is a cross sectional view at section lines C—C in FIG. 11 of an embodiment of the invention in the operative and expanded position.
Figure 10:
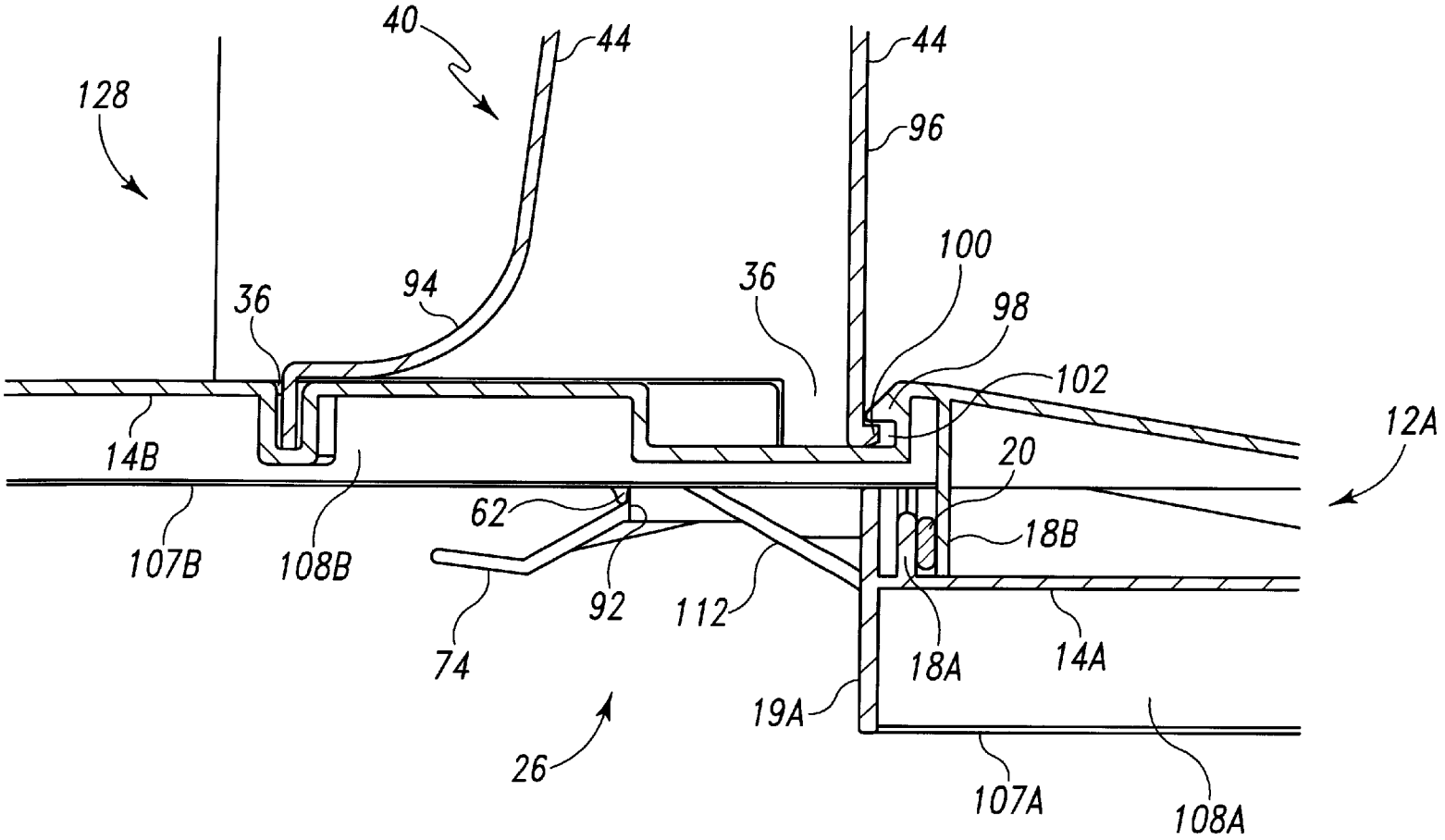
FIG. 10 is a cross-sectional view at section lines D—D of FIG. 4 of an embodiment of a locking mechanism of the invention and a vertical support of the bath ring assembly.

To mate sections 12A, 12B, in one embodiment of the invention, mounting brackets 22 may be attached to side wall 16B to couple to side wall 16A in the operative and/or inoperative position. Mounting brackets 22 may also provide a locking mechanism 24 to releasably latch with an appropriate locking mechanism on side wall 16A when in an expanded and locked position, as shown in FIGS. 1 and 7. As shown in FIGS. 4, 9, and 10, bath station 10 may additionally or alternatively include two locking mechanisms 26 on bottom walls 14A, 14B to help engage sealing mechanism 20.

Figure 3:
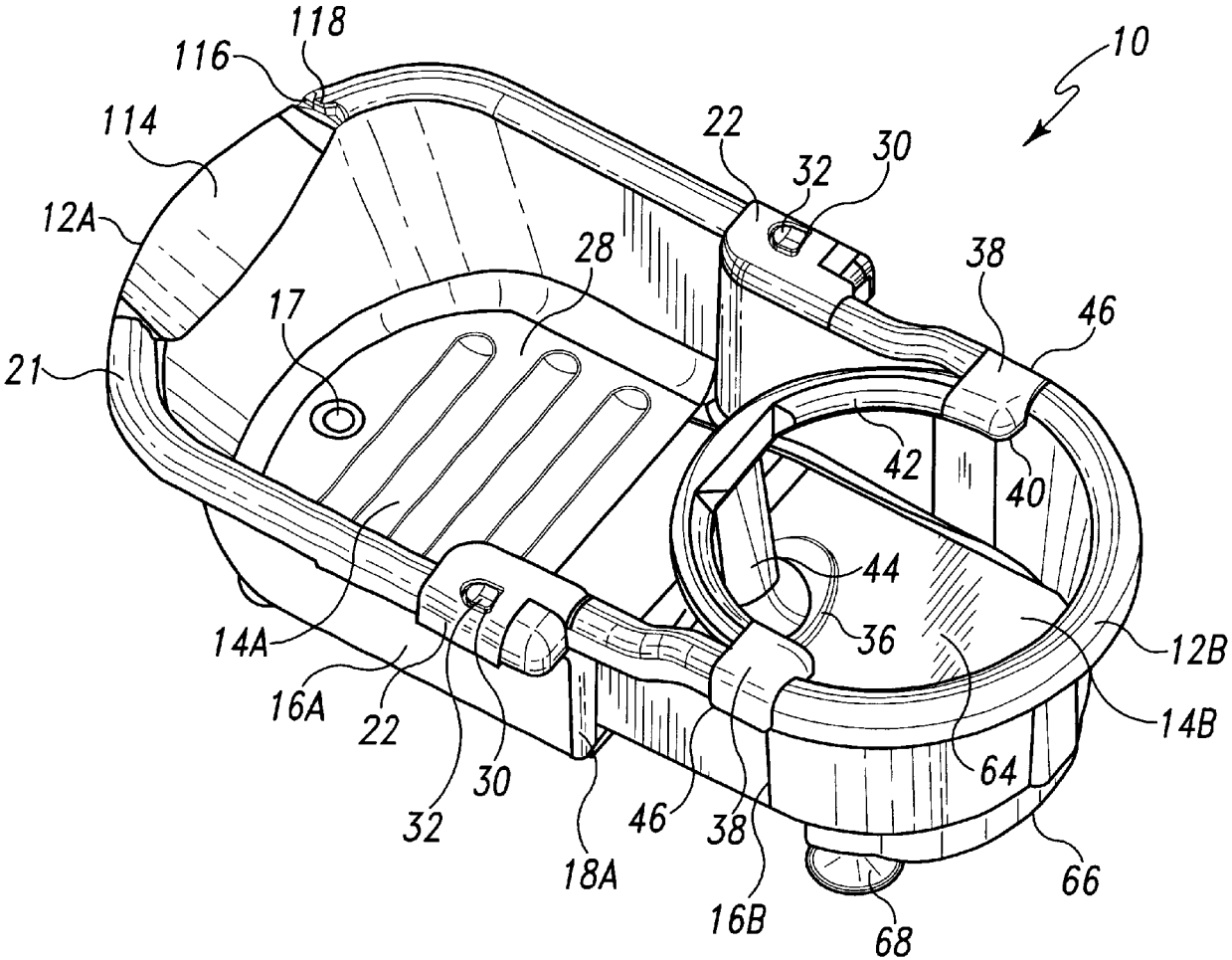
FIG. 3 is an alternative perspective view of an embodiment of the invention with the bath ring assembly in the operative position.
Figure 6:
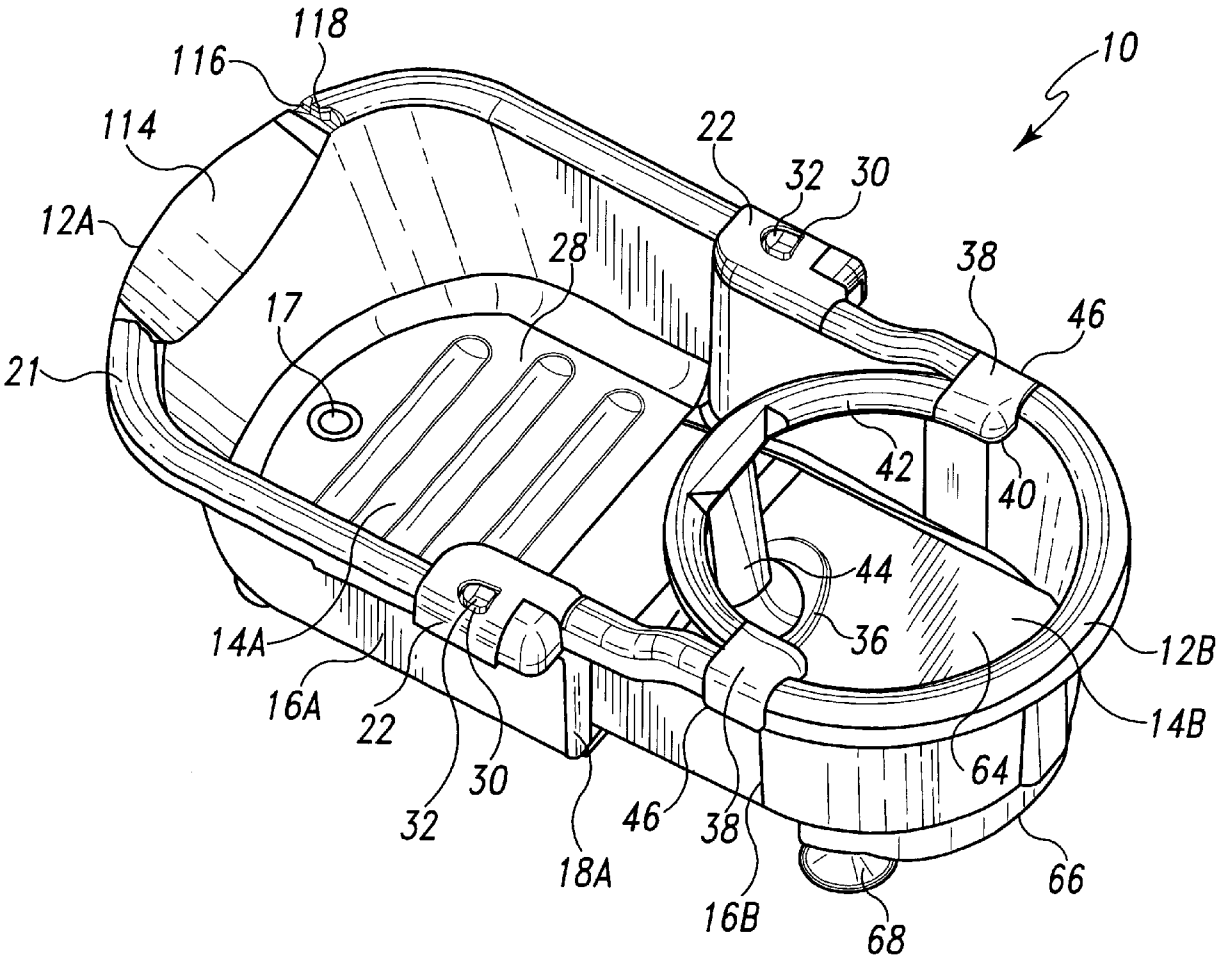
FIG. 6 is a perspective view of an embodiment of the invention as shown in FIG. 5 and further showing the bath ring assembly in the operative position.
Figure 13:
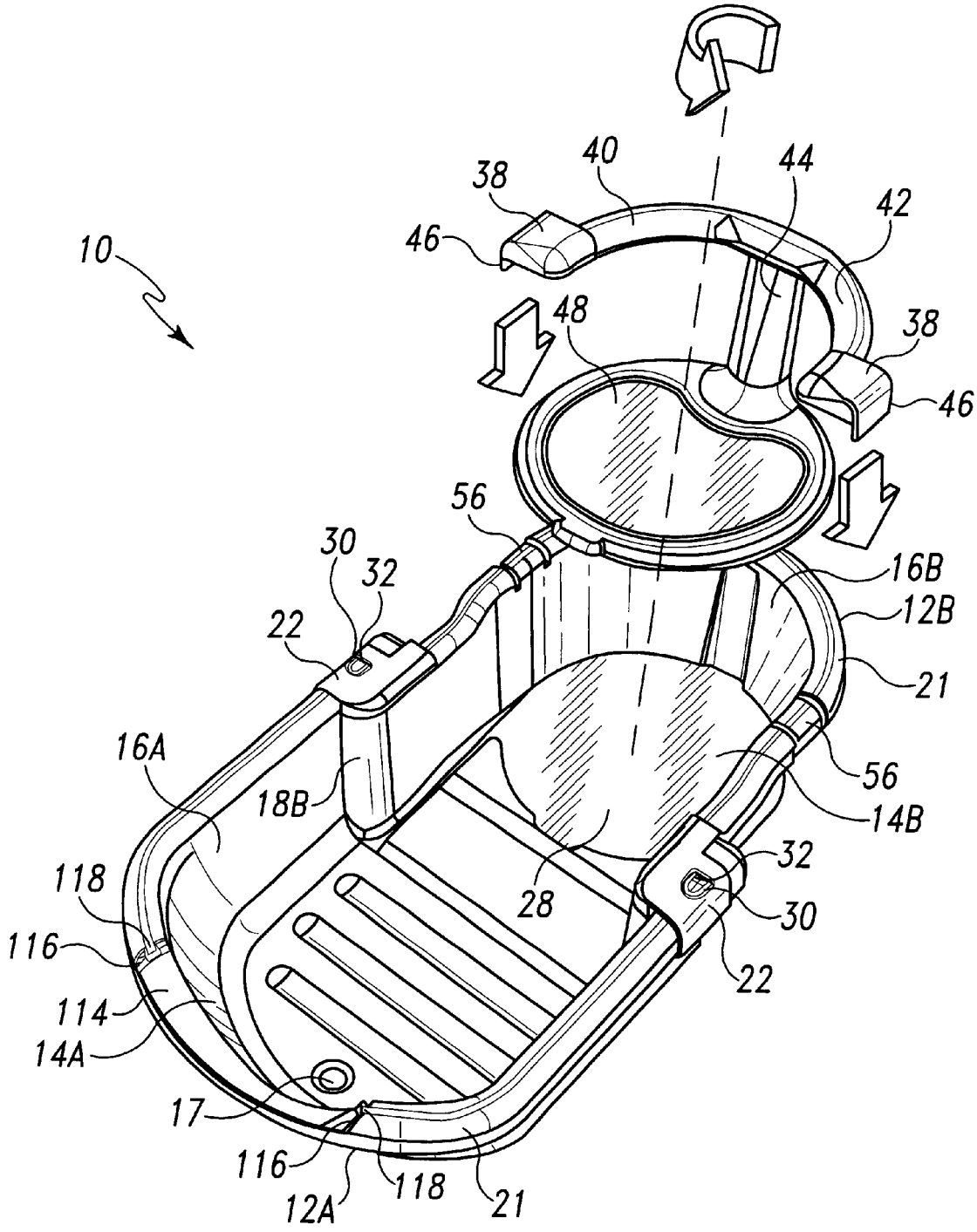
FIG. 13 is a perspective view of an embodiment of the invention as shown in FIG. 12 in the operative and expanded position and further showing the bath ring assembly separated from, but aligned with, the tub.
Figure 14:
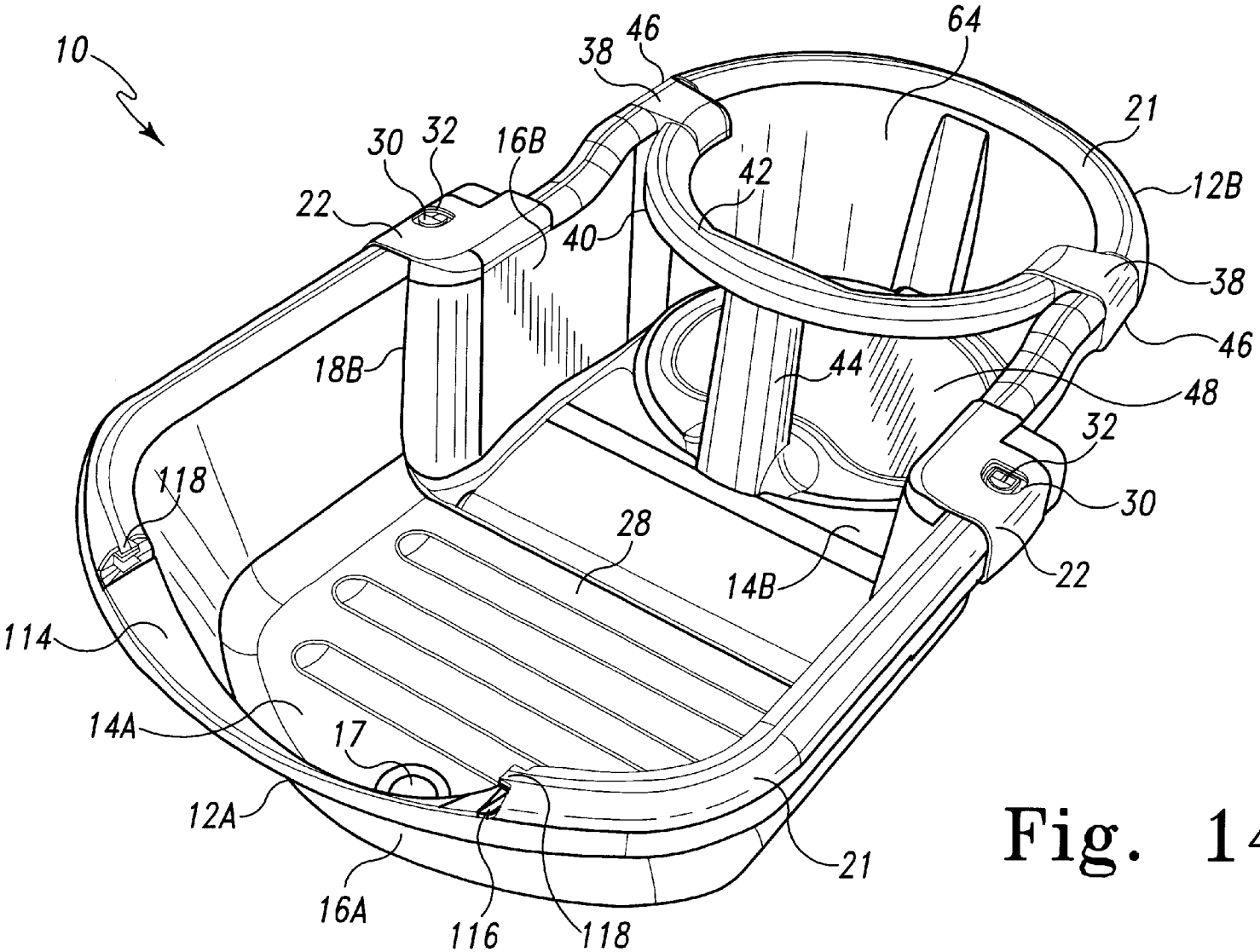
FIG. 14 is a perspective view of an embodiment of the invention with the bath ring assembly in the operative position.

The bath station 10 may also include, in one embodiment, a bath ring assembly 40 to support a child in a sitting position in bath cavity 28. One embodiment of the bath ring assembly is shown in FIGS. 3 and 6, and an alternative embodiment is shown in FIGS. 13 and 14. The bath ring assembly 40 includes at least one locking mechanism 46 for releasably locking the bath ring assembly 40 in the operational position as shown in FIGS. 3 and 14.

Although, the invention is shown and described having two sections 12A, 12B forming an ovate bath cavity 28, the invention is not limited in this respect and additional sections may be attached to either or both sections 12A, 12B and side walls 16A, 16B may form any appropriate shape for a child's bathing area, including but not limited to, ovals, diamonds, and rectangles. In addition, the side walls 16A, 16B may be integrally constructed with bottom walls 14A, 14B such that each section 12A, 12B forms an integral unit. Such construction may include, but is not limited to, injection molded plastic manufacturing.

The top of side walls 16A, 16B may extend outwardly from side walls 16A, 16B and may then extend downwardly substantially parallel to side walls 16A, 16B to define a side wall flange 21 with a skirt 78. Flange 21 also rigidifies the structure and provides comfortable arm rests for a baby in the bath station 10. The sections 12A, 12B are not limited to any particular embodiment as long as the volume of the bath cavity 28 may be reduces in the inoperative and storage position, and as long as the sealing mechanism 20, between the sections 12A, 12B and below the waterline of the main bathing cavity 28, forms a waterproof seal in the operative position.

The sealing mechanism 20 shown is generally semicircular, sealing the bath cavity 28 at ends 13A, 13B, and may be mounted proximate to the open end 13A of side wall 16A and bottom wall 14A of section 12A. Although the sealing mechanism 20 is shown and described as part of section 12A, the present invention is not limited in this respect and the sealing mechanism 20 may be mounted on both sections 12A, 12B or section 12B alone. Bottom wall 14A and side wall 16A may include a flange 18A attached proximate the open end 13 of the section 12A and extending radially from the bathing cavity 28. The sealing mechanism 20 may be fixably mounted on the flange 18A.

The sealing mechanism 20 may include a gasket made of compressible and flexible material such as rubber or plastic mounted on the flange 18A of section 12A. Those skilled in the art will recognize that many devices are capable of providing a waterproof seal between sections 12A, 12B, including, but not limited to, gaskets, valve mechanisms, resealable waterproof tapes.

In one embodiment of the invention as shown in FIG. 10, the sealing mechanism 20 may be fixably attached to the side of flange 18A facing away from the opposite section 12B. The other section 12B may also have a corresponding extending flange 18B to contact the sealing mechanism 20 attached to flange 18A to create a waterproof seal when the bath station 10 is expanded in its operative position. In one embodiment of the invention as shown in FIG. 10, flange 18A may extend radially inward towards the bathing cavity 28 and flange 18B may extend radially outward away from the bathing cavity 28. When the two sections 12A, 12B are expanded and jointly fitted together, the flange 18B of section 12B may compress the gasket mounted to flange 18A of section 12A and create a waterproof seal. Thus, an application of force forcing the section 12A away from section 12B compresses the gasket mounted on flange 18A. In such an embodiment, the sealing mechanism 20 mounted on section 12A and/or 12B may not be exposed to external forces or environment as it may be protected and surrounded by the flanges 18A, 18B on the sides with bottom wall 14B protecting the top and bottom wall 14A protecting the bottom of the sealing mechanism 20.

In an alternative embodiment of the invention, flanges 18A, 18B may extend radially from the bathing cavity 28 in the same direction, either radially inward towards the bathing cavity or radially outward from the bathing cavity. A sealing mechanism 20 may be fixably attached to the open end 13A side of flange 18A facing the opposite section 12B. Thus, the end 13B of section 12B may contact directly the gasket 20 or may also have a flange 18B to contact the gasket 20. Thus, application of force forcing the section 12A toward section 12B compresses the gasket 20 mounted between flanges 18A, 18B.

In another embodiment of the invention, an additional sealing mechanism 20, including, but not limited to a gasket as described above, may also be mounted on flange 18B. The gaskets on each section 12A, 12B may jointly engage each other in the operative position and create a waterproof seal around the bottom walls 14A, 14B and the side walls 16A, 16B of the bath station 10.

In another embodiment of the invention, the flange 18B may be formed with a recess or lip (not shown) to mate with and receive the sealing mechanism 20 mounted on section 12B. In the expanded and operative position, sealing mechanism 20 mounted on flange 18A may contact three sides of the lip (not shown) on flange 18B to create a substantially waterproof seal.

In a further embodiment of the invention, section 12A and/or 12B may include a secondary flange 19A, 19B, as shown in FIGS. 9 and 10, placed substantially parallel to and outside flanges 18A, 18B at open ends 13A, 13B to further protect the sealing mechanism 20 from the external environment and for cosmetic appeal and comfort. The bottom wall 14B may extend from flange 18B to flange 19B to form a more continuous surface to the bottom of bathing cavity 28 where end 13B contacts the bottom wall 14A of section 12A as shown in FIG. 9.

Figure 12:
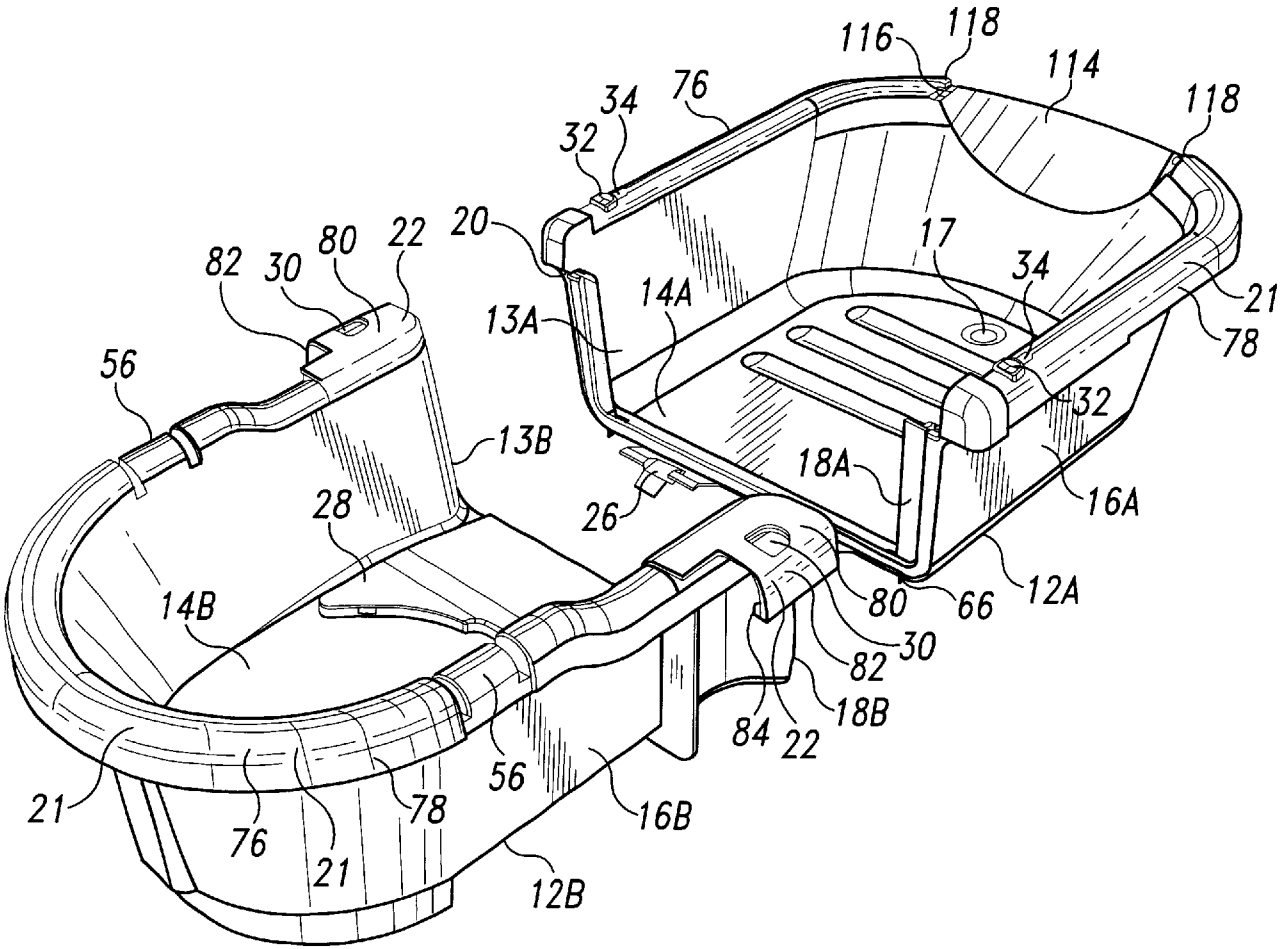
FIG. 12 is an exploded view of an embodiment of the invention.

To mate sections 12A, 12B in the operative position and to help engage sealing mechanism 20, mounting brackets 22 may be attached to side walls 16A, 16B. In one embodiment of the invention as shown in FIGS. 7 and 12, mounting brackets 22 may be removably attached to side wall 16A and fixably attached to side wall 16B, and in a further embodiment of the invention, mounting brackets 22A, 22B may be integrally constructed as part of side wall 16B. Mounting brackets 22 may slidably couple to side wall 16A and guide the sections 12A, 12B into a proper expanded operating position and may also maintain attachment of the sections 12A, 12B in the collapsed and storage position of the bath station 10, as shown in FIG. 2 where the two tub section 12A, 12B telescope together. Flange 21 may provide support to and help guide mounting brackets 22 when collapsing or expanding sections 12A, 12B.

As shown in FIGS. 7 and 12, mounting brackets 22 may also extend outwardly and downwardly to define corresponding flange 80 and skirt 82 to matably couple external to side wall flange 21 and skirt 78. Skirt 82 may also include a lip 84 to engage the internal side of skirt 78 to fixably or removably couple the mounting brackets 22 to side wall 16B.

Mounting brackets 22 may include a locking mechanism 24 to mate sections 12A, 12B in the operative position and help engage sealing mechanism 20. Locking mechanism 24 may be mounted on flange 80 of mounting brackets 22 or alternatively, on skirt 82 of mounting brackets 22. Locking mechanism 24 may indicate when the sections 12A, 12B are fully extended to the operative position.

In one embodiment of the invention, locking mechanism 24 provides a recess 30 adapted to engage a corresponding button 32 fixably attached to flange 21 or skirt 78 at the top 76 of side wall 16A. Recess 30, in one embodiment of the invention, may be an indentation on the bottom side of locking mechanism 24 matable with a corresponding indention on the top 76 of side wall 16A. In a preferable embodiment of the invention as shown in FIG. 7, recess 30 may be formed as a cut out in locking mechanism 24 to allow a user to access button 32 to disengage it from recess 30 of locking mechanism 24. In one embodiment of the invention, button 32 is integrally formed with flange 21 of side wall 16A. Button 32 may be integrally formed with flange 21 at an attachment point 86 and may otherwise be unattached to flange 21. Thus, button 32 may move in a direction perpendicular to the surface of flange 21 allowing the button 32 to enter and exit the corresponding recess 30 and mounting brackets 22.

In a further embodiment of the invention, button 32 may be fixably attached to a leaf spring 34 at attachment area 86, and the spring 34 may be fixably attached to flange 21 of side wall 16A. In use, the leaf spring 34 forces the button 32 outward to engage recess 30 when the bath station 10 is in the expanded and locked position. Button 32 may be pressed against the engaging force of leaf spring 34 to disengage the button 32 from recess 30 and thus allow mounting brackets 22 to slide along flange 21 and collapse sections 12A, 12B together, and in one embodiment, slidably telescope together. Those skilled in the art will recognize that many attachment and locking devices are suitable for locking and releasing sections 12A, 12B together, including, but not limited to tongue and groove mechanisms, clamps, hooks, latches, clips, vises, and screws, as long as locking mechanism 24 may releasably join sections 12A, 12B.

Button 32 may also include a tab 88 mounted on the opposite side of button 32 from the attachment point 86. Tab 88 may contact the underside of mounting bracket 22 proximate recess 30 and prevent button 32 from extending above the surface of mounting bracket 22. As shown in FIG. 7, leaf spring 34 may also include a second leaf spring 90 attached to side wall 16A and to button 32 proximate the tab 88. Leaf spring 90 may provide additional rigidity and stability to leaf spring 34. Button 32 may be tapered proximate the attachment point 86 or formed as a ramp as shown in FIG. 7, allowing mounting bracket 22 to easily slide over button 32 as the sections 12A, 12B are placed in an inoperative position.

Bath station 10 may also include two locking mechanisms 26 to releasably attach sections 12A, 12B in the operative position and help engage sealing mechanism 20. In a preferable embodiment of the invention as shown in FIG. 4, locking mechanisms 26 are equally spaced about the center line of the bath station 10. In one embodiment of the invention, locking mechanisms 26 may be fixably mounted on the bottom side of bottom wall 14A, and in a further embodiment of the invention, locking mechanisms 26 are integrally formed with bottom wall 14A. In one embodiment of the invention, locking mechanisms 26 each include at least one abutment 92.

Each abutment 92 of locking mechanism 26 may engage a corresponding abutment 62 fixably attached to the bottom wall 14B of section 12B. In one embodiment of the invention, the abutment 62 is integrally formed with the bottom wall 14B. In the expanded and locked position, each abutment 92 of locking mechanism 26 may be placed in contact with a corresponding abutment 62 to provide a force to engage sealing mechanism 20. Abutment 92 and abutment 62 are placed such that when engaged, a compressive force is placed on sealing mechanism 20 to create a waterproof seal. Abutment 92 may also include a leaf spring 112 biased towards the latched position. Leaf spring 112 may exert pressure against the abutment 92 forcing the abutment 92 against bottom wall 14B to stably engage abutment 62. Locking mechanism 26 may also include a tab 74 fixably attached to abutment 92 to release abutment 92 from its compressive contact with abutment 62 and release sections 12A, 12B. Although the invention is shown and described with reference to two locking mechanisms 26, the invention is not limited in this respect and any number of locking mechanisms may be appropriate for locking the sections 12A, 12B in the expanded and locked position to engage the sealing mechanism 20. Furthermore, although the invention is shown and described with reference to a continuous abutment 92 and abutment 62, the invention is not limited in this respect either or both abutments may be continuous or interrupted.

Figure 5:
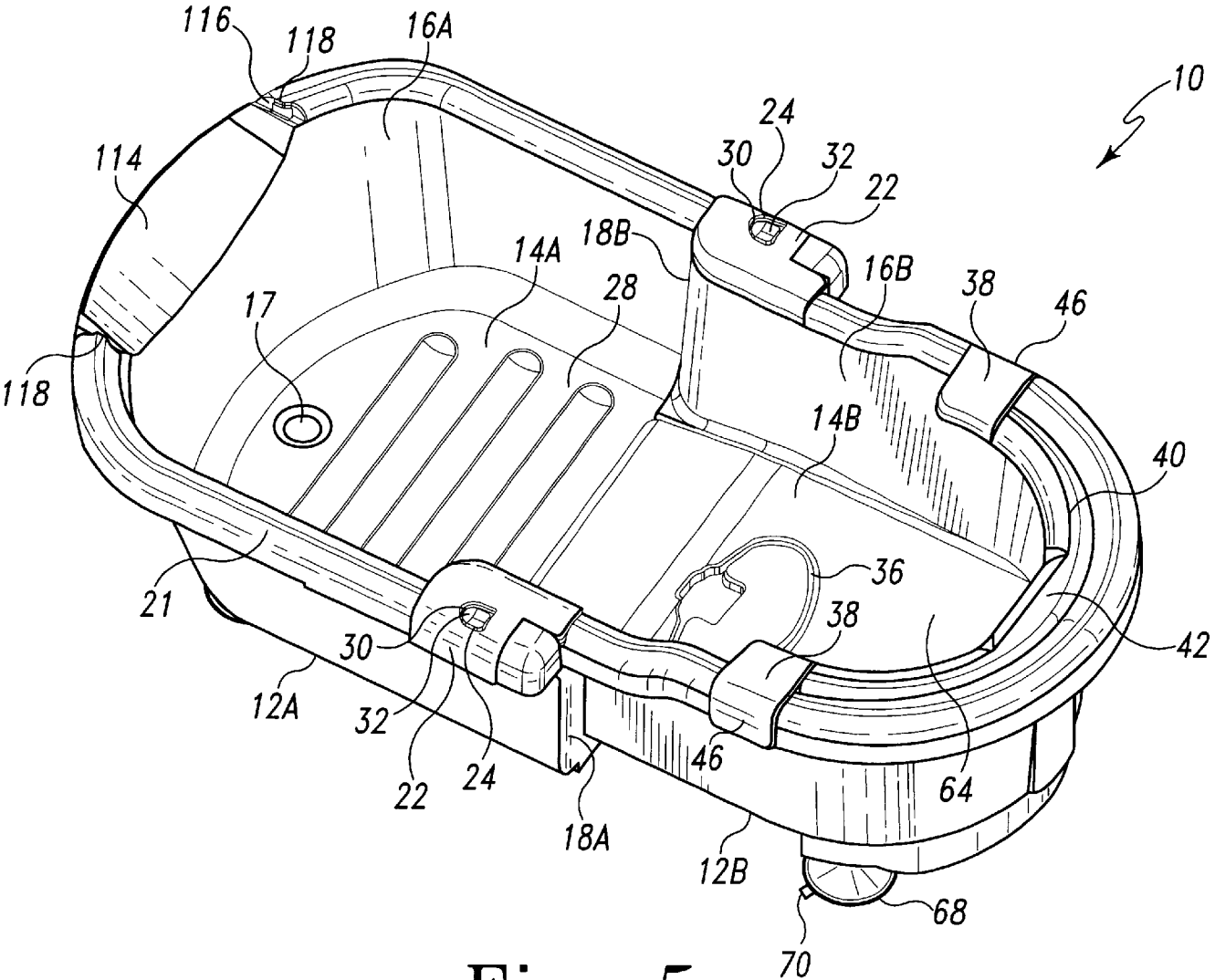
FIG. 5 is a perspective view of an embodiment of the invention in the operative, expanded, and locked position with the bath ring assembly in the inoperative position.
Figure 15:
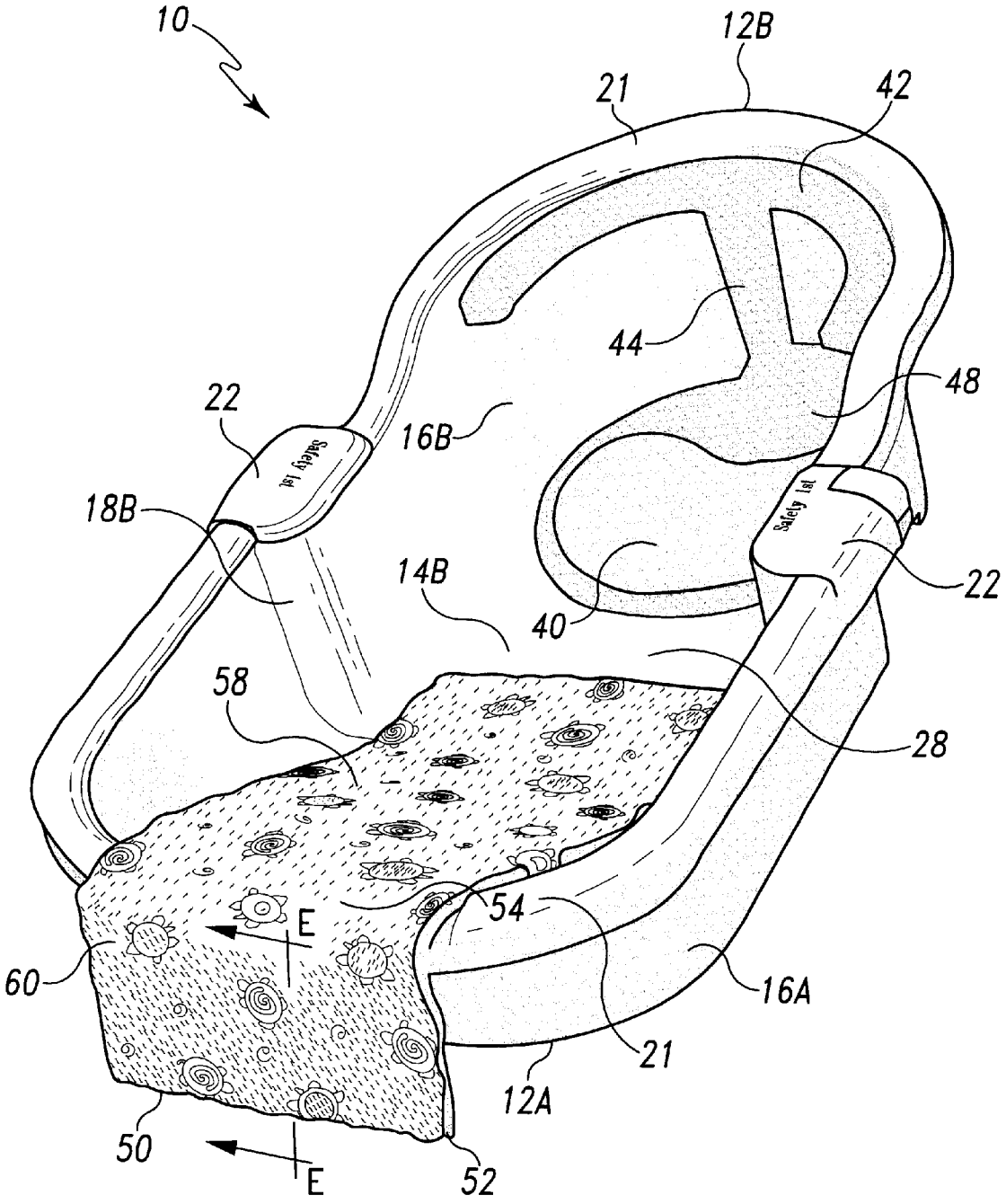
FIG. 15 is a perspective view of another embodiment of the invention with a sling support disposed in the operative position within the tub.

As noted above, bath station 10 may also include a bath ring assembly 40 to support a child in a sitting position in the bath cavity 28. One embodiment of the bath ring assembly is shown in FIGS. 3 and 6, and an alternative embodiment is shown in FIGS. 13 and 14. The bath ring assembly 40 is attached to bath station 10 and in one embodiment of the invention, the bath ring assembly 40 may be attached to section 12B such that the bath station 10 may be collapsed whether the bath ring assembly 40 is in the operative or inoperative position. The bath ring 40 has an operative position defining a sitting area 64 as shown in FIGS. 3 and 6 between the back side of wall 16B and bath ring assembly 40. The bath ring assembly 40 has an inoperative position wherein the bath ring assembly 40 may be fully removed from the bath station 10, or in one embodiment of the invention, may be attached to the bath station 10 in such a manner as to not obstruct the main bathing cavity 28, as shown in FIGS. 2, 5, and 15, for a child who may be in a sitting position or for an infant who may be in a reclining position.

In one embodiment of the invention, the bath ring assembly 40 includes a substantially U-shaped or semi-circular arm 42 for providing support to a child's stomach and chest area when in a sitting position. The bath ring assembly 40 may also include a vertical support or post 44 attached to the bath ring assembly 40 preferably near the mid-point of the semi-circular arm 42.

In one embodiment of the invention, the vertical support 44 is fixably attached to the arm 42, and in a further embodiment of the invention, the arm 42 and vertical support 44 are integrally formed. Vertical support 44 provides pelvic support by creating separate leg openings for the child's legs in a sitting position to prevent the child from sliding down to a reclining position. Vertical support 44 may be shaped and formed to provide a tapered surface towards the sitting area 64 of the bathing cavity 50. The tapered back wall 94, as shown in FIG. 9, may provide an arcuate surface such that no sharp edges may contact a child in the sitting position.

The vertical support 44 may contact the bottom wall 14B of the bath station 10 when in the operative position. The vertical support 44 may, then, provide additional vertical support to the bath ring assembly 40 if pressure is applied to the top of the arm 42. In a further embodiment of the invention, the vertical support 44 may be removably attached to the bottom wall 14B in the operative position, thus, the vertical support 44 may also provide horizontal support for or resist torsion of the arm 42 if pressure is applied to the arm 42 in a horizontal direction.

In a further embodiment of the invention as shown in FIGS. 9 and 10, bottom wall 14B may be adapted to mate with the bottom of vertical support 44 to prevent horizontal movement of the vertical support 44 in the operative position. In one embodiment of the invention, bottom wall 14B may include a groove 36 adapted to mate with the bottom of vertical support 44 as shown in FIG. 10. Groove 36 may include a ridge 98 extending radially into the groove 36 to provide a recess 102 within groove 36. The front wall 96 of vertical support 44 may have a corresponding tab 100 to engage the recess 102 under the ridge 98 within the groove 36. Thus, tab 100 removably locks vertical support 44 into groove 36. To disengage vertical support 44 from groove 36, the front wall 96 of vertical support 44 may be deflected as a leaf spring and pressed away from the recess 102 and into groove 36 to release the tab 100 from recess 102. Ridge 98, tab 100, and recess 102 may be placed around the entire circumference of groove 36, or may be selectively placed in one area on groove 36 as shown in the illustrated embodiment of FIG. 10, or multiple areas in groove 36.

Figure 8:
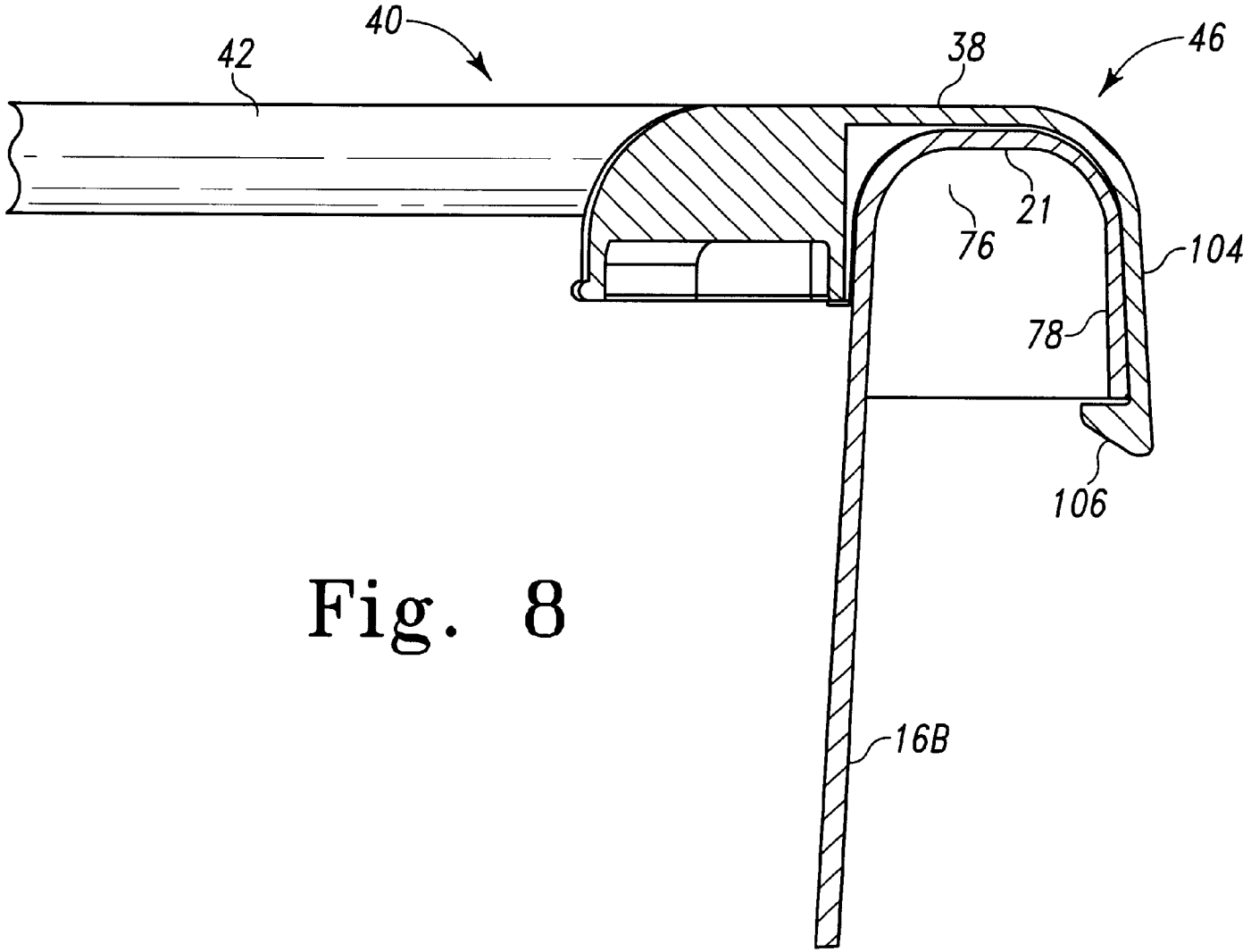
FIG. 8 is a cross sectional view at section lines B—B in FIG. 11 of an embodiment of a locking mechanism for a bath ring assembly.

In one embodiment of the invention, the bath ring assembly 40 may include at least one locking mechanism 46 for releasably attaching the bath ring assembly 40 to the top 76 of side wall 16B. In the operative position, the locking mechanism 46 may be fixably attached to the ends of arm 42 and removably attached to side wall 16B. In one embodiment of the invention as shown in FIGS. 8 and 13, the locking mechanism 46 may include two locking mechanisms adapted to fit over or into the corresponding top edges 76 of side wall 16B. In a further embodiment of the invention, each locking mechanism 46 may include a flange 38 extending radially from the end of arm 42 over flange 21 on the side wall 16B. Flange 38 may also have a skirt 104 corresponding to skirt 78 of section 12B. Skirt 104 may also have a lip 106 extending radially inward towards sidewall 16B to releasable attach locking mechanism 46 to sidewall 16B. Although the invention is shown and described with reference to a single lip 106, the invention is not limited in this respect and lip 106 may be continuous or interrupted.

In one embodiment of the invention, locking mechanism 46 may lock directly over flange 21, or alternatively as shown in FIG. 12, flange 21 may provide a recess 56 shaped and formed to receive locking mechanism 46. Flange 38 and recess 56 are preferably adapted to securely mate with one another when attached in a locked position. To release locking mechanism 46 from side wall 16B, lip 106 may be pulled away from the edge of skirt 78, flexing the material of skirt 104, to release locking mechanism 46 and remove assembly 40. Those skilled in the art will recognize that many locking mechanisms are suitable for removably attaching the bath ring assembly 40 to the bath station 10, including, but not limited to, snaps, hooks, latches, pins, screws, hole and pegs, and tongue and groove mechanisms.

In one embodiment of the invention as shown in FIG. 12, two recesses 56 may be placed on flange 21 of side wall 16B such that bath ring assembly 40 may be locked in an inoperative position or an operative position using the same two recesses 56 corresponding to the two locking mechanisms 46 at the ends of arm 42. In one embodiment of the invention, flange 21 may include at least four recesses 56 (not shown). Two recesses 56 may be used to attach bath ring assembly 40 to bath station 10 in the operative position and two additional recesses 56 may attach the bath ring assembly 40 in an inoperative position.

In one embodiment of the invention as shown in FIGS. 2, 5, and 15, locking mechanism 46 may be mated to side wall 16B such that the vertical support 44 is along the back side wall 16B and the arm 42 is arranged along the top edge of back side wall 16B, placing the bath ring assembly 40 in an inoperative position and attached to the bath station 10. In a further embodiment of the invention, the back side wall 16B may be shaped and formed to mate with the arm 42 in the inoperative position.

Figure 11:
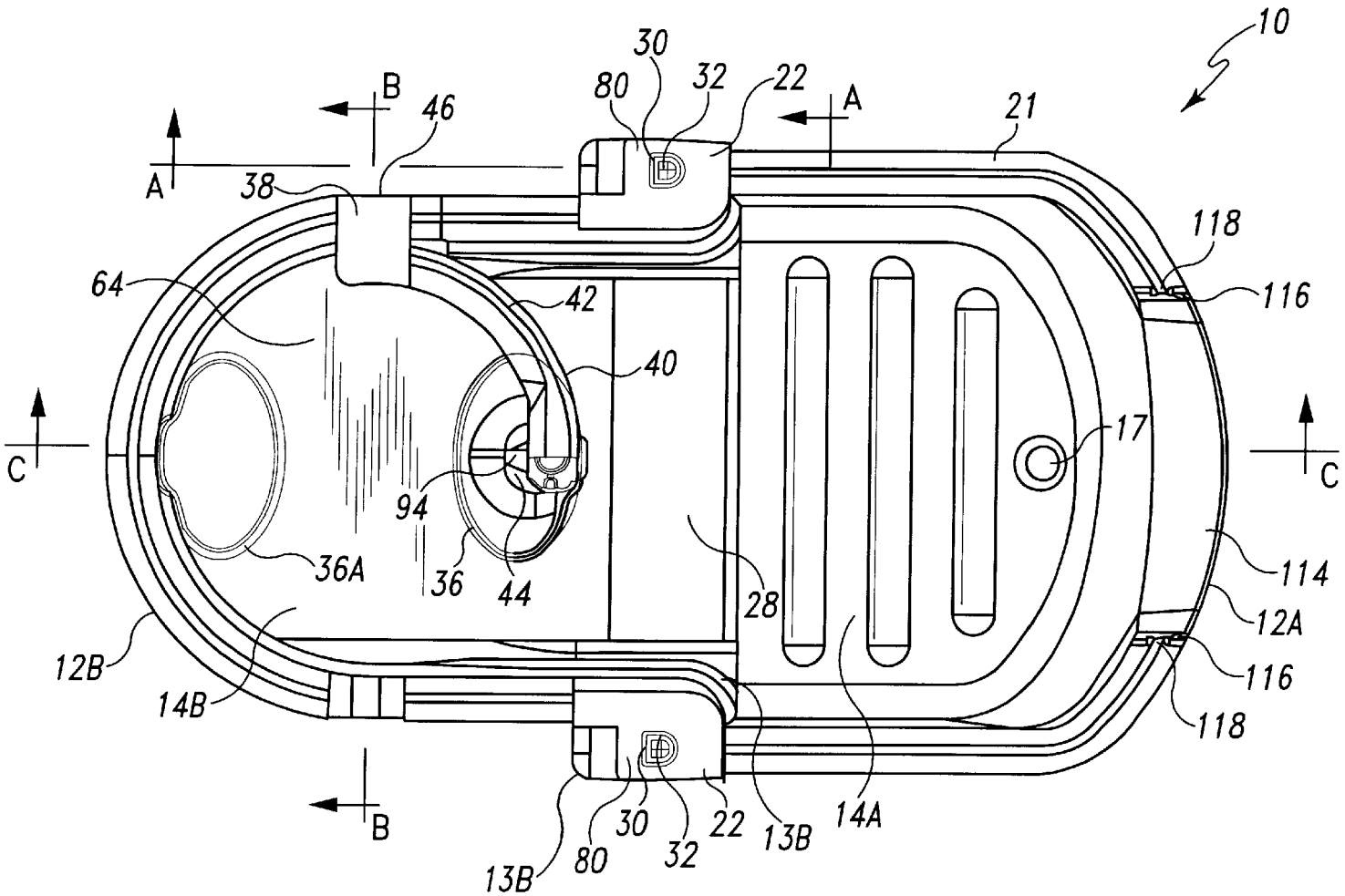
FIG. 11 is a top view of an embodiment of the invention in the operative and expanded position with a portion of the bath ring assembly cut away.

Similarly as described above with respect to groove 36, the bottom wall 14B may be adapted to mate with the bottom of vertical support 44 to prevent horizontal movement of the vertical support member 44 in the inoperative position. In one embodiment of the invention as shown in FIG. 11, bottom wall 14B may provide a groove 36A adapted to mate with the bottom of vertical support 44 in the inoperative position and provide a groove 36 to mate with the bottom of vertical support 44 in the operative position.

In one embodiment of the invention, locking mechanism 46 may be released to fully remove bath ring assembly 40 from bath station 10 to provide an additional inoperative position for the bath ring assembly 40. When fully removed, bath ring assembly 40 may be reversed to place the bath ring assembly 40 in an operative or inoperative position within the bath cavity 28.

In another embodiment of the invention as shown in FIGS. 12, 13, 14, and 15, bath ring assembly 40 may include a base 48 that is rotatably mounted to bottom wall 14B. Thus, rather than removing bath ring assembly 40 from the bath cavity 28 to change from the operative and inoperative positions, bath ring assembly 40 and base 48 may be rotated within the bath cavity 28 into the operative or inoperative position. Bottom wall 14B may provide a recess 110, as shown in FIG. 12, shaped and formed to receive base 48 such that the top of base 48 is substantially contiguous with the internal side and bottom wall 14B and bathing cavity 28.

In a further embodiment of the invention, bath ring assembly 40 may include a locking mechanism 46 to lock the bath ring assembly in an operative or an inoperative position. In one embodiment of the invention, the locking mechanism 46 may be an attachment device between arm 42 and side wall 16B as described above. In an alternative embodiment of the invention as shown in FIG. 8, the arm 42 may not be attached to side walls 16A, 16B in the operative or inoperative position. Locking mechanism 46 may include a detent mechanism which enables retaining the rotatable base 48 in a desired rotational position with respect to the bottom wall 14B. As is well known in the art, many locking mechanisms are suitable for locking the rotatable base to the bottom wall 14B including, but not limited to, friction detents, tongue-and-groove mechanisms, spring/pin mechanisms, clamps, hooks, latches, clips, and screws.

Figure 16:
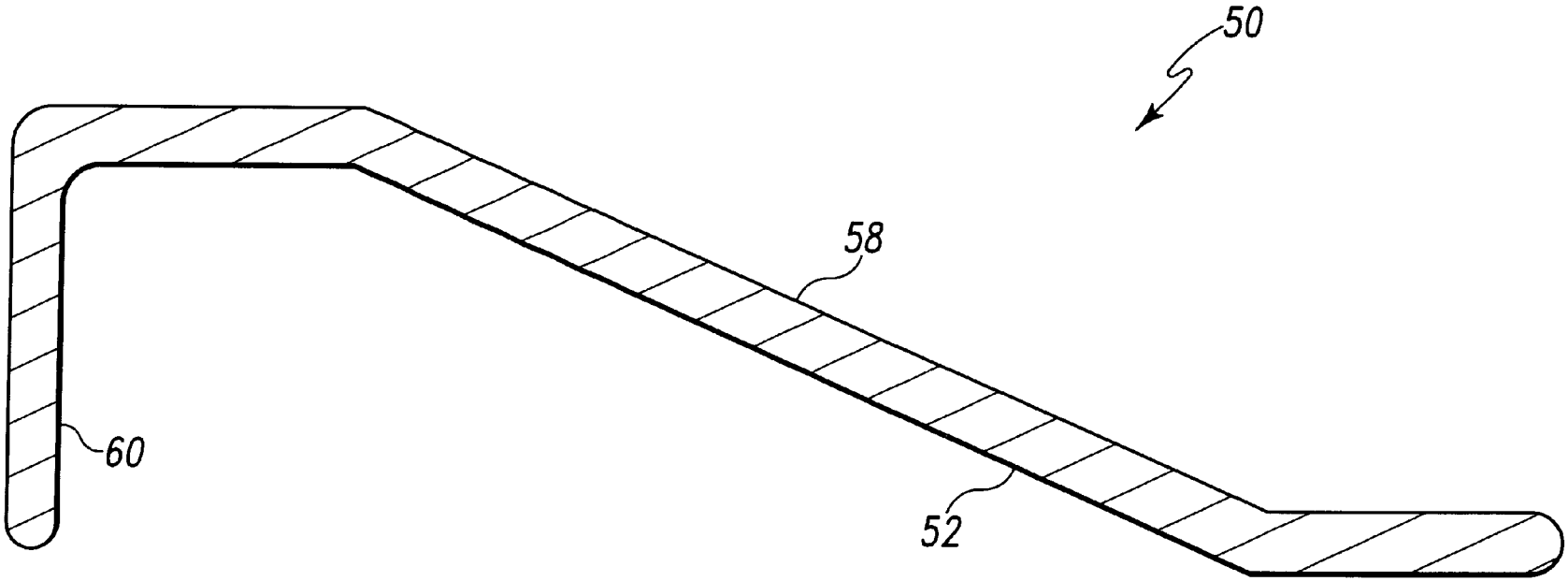
FIG. 16 is a cross-sectional view of an embodiment of a bath sling of the invention.

Bath station 10 may also include a bath sling 50 as shown in FIGS. 15 and 16. In one embodiment of the invention, the bath sling 50 may be constructed of a rigid and open frame 52 with a covering 54. As is well known in the art, many materials are suitable for covering 54, including, but not limited to, lightweight fabrics, meshes, or plastics, as long as the covering 54 provides some friction between the covering 54 and a wet baby so as to prevent the baby from sliding down the ramp 58. Preferably, the covering 54 is also slightly elastic to increase the comfort of a baby reclining in the bath sling 50 and is preferably mildew resistant. The rigid frame 52 may be shaped to provide a mounting lip 60 to removably attach to or hook over the back side of side wall 16. Bath sling 50 also provides a reclining ramp 58 extending into the bathing cavity 28 to provide support for a reclining infant. Mounting lip 60 may support the ramp 58 when the bath sling 50 is placed over side wall 16 or may also support the ramp 58 when the bath sling 50 is placed directly on any flat surface, such as a sink, adult tub, or floor.

In a further embodiment of the invention as shown in FIGS. 1, 2, 3, 5, 6, 9, 11, 12, 13, and 14, side wall 16A may be shaped and formed to provide an attachment recess 114 at the top 76 of side wall 16A. Attachment recess 114 may have walls 116 to horizontally support a sling 50 place within attachment recess 114. In a further embodiment of the invention, the support wall 116 may be shaped and formed to provide locking tabs 118 to releasably lock the sling 50 in the attachment recess 114. Although the invention is shown and described with reference to an attachment recess and locking tabs on side wall 16A, many mounting methods are suitable including, but not limited to, tongue and groove structures, detents, and hook and loop fasteners on the side wall 16A and sling 50 and similarly, sling 50 may be mounted to side wall 16B, which may be shaped and formed to support sling 50.

In one embodiment of the invention as shown in FIG. 4, the bottom side of bottom wall 14A, 14B may include support ridge or legs 66 to provide additional support when the bath station 10 is placed on a flat surface, such as a bathtub or a countertop. Although the invention is shown and described with reference to a continuous ridge 66, the invention is not limited in this respect and any suitable support structure may be employed to provide additional support to the bottom wall 14A, 14B. In a further embodiment of the invention, the support legs 66 may include suction cups 68, as shown in FIGS. 1, 2, 3, 5, 6, and 9, to augment support of the bath station 10 when placed on a slippery surface. The suction cups 68 may include a side tab 70, as shown in FIGS. 1, 5, and 9, on the edge of the suction cup 68 to help release the suction of a suction cup 68 when removing the bath station 10 from the surface.

In one embodiment of the invention as shown in FIG. 10, the bottom side of bottom wall 14A, 14B may provide a double wall with an external facing wall 107A, 107B as shown in FIG. 9. External facing wall 107A, 107B form a sealed cavity 108A, 108B between facing wall 107A, 107B and bottom wall 14A, 14B. The external facing wall 107A, 107B may protect the integrally formed structures in bottom wall 14A, 14B from damage during use and/or storage of the bath station 10 as well as provide cosmetic appeal and stability of the bath station 10 when placed on a flat surface.

Bottom wall 14A, bottom wall 14B, sidewall 16A, and/or sidewall 16B may have a drain 17 at a low point to assist in draining water from the bath station 10.

It will be understood that each of the elements described herein, or two or more together, may be modified or may also find utility in other applications different from those described above. While particular embodiments of the invention have been illustrated and described, it is not intended that the invention be limited to the details shown, since various modifications and substitutions may be made without departing in any way from the spirit of the present invention as defined by the following claims.

What is claimed is:

1. A small child's bath station comprising:

a) at least two tub sections, each tub section having a substantially open top, that together are adapted to expand in a longitudinal direction to define a bath tub with a bath cavity and having a volume in an expanded, operative position, wherein the bath tub has a bottom wall and a side wall with the side wall extending about all sides of the bottom wall, the open tops of the tub sections defining a substantially open and continuous top of the bath cavity; and b) a mechanism associated with at least one of the tub sections being adapted to releasably lock the tub sections together and compress at least a portion of the tub sections toward each other in the longitudinal direction so as to form a waterproof seal at the bottom wall and the side wall, maintaining the substantially open top of the bath cavity, and when released is adapted to enable the at least two tub sections to collapse together to reduce the volume of the bath tub in a collapsed storage position.

2. The bath station as claimed in claim 1, wherein at least two tub sections are shaped and sized to allow one tub section to be placed within the other tub section in the storage position.

3. The bath station as claimed in claim 2, wherein at least two tub sections telescope together in the storage position.

4. The bath station as claimed in claim 1, further comprising a drain placed at a low point in the bath cavity.

5. The bath station as claimed in claim 1, wherein the mechanism includes a gasket mounted at an open end of at least one tub section.

6. The bath station as claimed in claim 5, wherein the gasket is mounted on a flange attached to the open end of at least one tub section.

7. The bath station as claimed in claim 6, wherein at least two tub sections include a flange and the mechanism includes a gasket mounted on at least one flange.

8. The bath station as claimed in claim 7, wherein the at least two flanges interlock to engage the mechanism.

9. The bath station as claimed in claim 8, wherein the mechanism is adapted to apply a force in the longitudinal direction to compress the gasket between the at least two flanges and to extend the tub sections in the longitudinal direction to engage the mechanism.

10. The bath station as claimed in claim 8, wherein a first flange extends radially inwardly towards the bath cavity, and a second flange extends radially outwardly away from the bath cavity.

11. The bath station as claimed in claim 1, further comprising at least one mounting bracket attached to the side wall to slidably couple at least two tub sections.

12. The bath station as claimed in claim 11, wherein the at least one mounting bracket slidably couples at least two tub sections when collapsing or expanding the tub sections into an operative or storage position.

13. The bath station as claimed in claim 1, wherein the mechanism comprises a locking mechanism mounted to at least one mounting bracket, the locking mechanism adapted to latch at least two tub sections into the operative position and adapted to release at least two tub sections into the storage position.

14. The bath station as claimed in claim 13, wherein the locking mechanism includes at least one leaf spring attached to a side wall of at least one tub section and a button attached to the leaf spring, wherein the button is adapted to mate and couple with a recess in at least one mounting bracket.

15. The bath station as claimed in claim 1, wherein the mechanism comprises a locking mechanism mounted on a bottom side of the bottom wall.

16. The bath station as claimed in claim 15, wherein the locking mechanism includes at least one first abutment mounted to the bottom wall of at least one tub section and is adapted to engage a second abutment mounted on a separate tub section.

17. The bath station as claimed in claim 16, wherein at least one tab is fixably attached to at least one first abutment, wherein the tab is adapted to release the first abutment from engagement with the second abutment.

18. The bath station as claimed in claim 16, wherein the first abutment includes a leaf spring exerting pressure against the first abutment when placed in a locked and operational position.

19. The bath station as claimed in claim 1, further comprising a bath ring assembly mounted on one of the tub sections and moveable between a ring operative position and a ring inoperative position, the ring operative position being adapted to support a child in the sitting position within the bath tub and the ring inoperative position being out of the way so as not to obstruct use of the bath cavity by a child in a reclining position therein.

20. The bath station as claimed in claim 19, wherein the bath ring assembly includes an arcuate arm removably attached to the side wall of the bath tub.

21. The bath station as claimed in claim 20, wherein the bath ring assembly further includes a vertical support attached to the arm.

22. The bath station as claimed in claim 21, wherein the bottom wall of the bath tub is adapted to mate with the bottom of the vertical support in the ring operative position.

23. The bath station as claimed in claim 21, wherein the bottom wall of the bath tub is adapted to mate with the bottom of the vertical support in the ring inoperative position.

24. The bath station as claimed in claim 20, wherein the arm is semi-circular.

25. The bath station as claimed in claim 19, wherein the bath ring assembly includes at least one ring locking mechanism for releasably attaching the bath ring assembly to the side wall of the bath station.

26. The bath station as claimed in claim 25, wherein the ring locking mechanism includes a connector adapted to fit over a top edge of the side wall of the bath tub.

27. The bath station as claimed in claim 26, wherein the side wall is shaped and adapted to mate with the connector of the ring locking mechanism.

28. The bath station as claimed in claim 19, wherein the bath ring assembly may be removed from the bath station when placed in the ring inoperative position.

29. The bath station as claimed in claim 19, wherein the bath ring assembly further includes a base that is rotatably mounted to the bottom wall of the bath tub.

30. The bath station as claimed in claim 1, further comprising at least one support member to provide additional support for the bath station when placed on a flat surface.

31. The bath station as claimed in claim 1, further comprising at least one suction cup attached to the at least one support member.

32. The bath station as claimed in claim 1, further comprising a bath sling removably mounted in the bath station for supporting a newborn.

33. The bath station as claimed in claim 32, wherein the bath sling is constructed of a rigid and open frame with a covering.

34. The bath station as claimed in claim 32, wherein the bath sling includes a mounting lip to removably mount the bath sling to the bath station.

35. The bath station as claimed in claim 32, wherein the bath sling includes a reclining ramp extending into the bath cavity to support a reclining infant.

36. The bath station as claimed in claim 32, wherein the bath sling is constructed from a rigid frame with a covering.

37. The bath station as claimed in claim 19, wherein the bath ring assembly is placed against the side wall when the bath ring assembly is in the ring inoperative position.

38. A small child's bath station comprising:

a) a bath tub having a bottom wall and a side wall extending about all sides of the bottom wall and forming a bath cavity with two ends; and b) a substantially rigid bath ring assembly movably mounted in the bath tub between a ring operative position and a ring inoperative position, the ring operative position being adapted to support a child in a sitting position in the bath tub with at least two connectors, each connector being adapted to fit over a top edge of opposing sides of the side wall of the bath tub, and the ring inoperative position being adapted to enable a child to recline in the bath tub.

39. The bath station as claimed in claim 36, wherein the bath ring assembly further includes a vertical support attached to the arm.

40. The bath station as claimed in claim 36, wherein the bath ring assembly includes:

a) a seat that rests on the bottom of the tub; and b) a vertical support attached to the bath ring assembly and that extends upwardly from the seat and suitable to fit between the legs of a child to further support the child when the bath ring assembly is in the operative position.

41. The bath station as claimed in claim 38, wherein the bath tub has at least two tub sections that collapse together to reduce a volume of the bath tub.

42. The bath station as claimed in claim 38, wherein the bath ring assembly includes a substantially arcuate arm having two ends, at least one connector being located proximate each end of the arm, and wherein the arm, in the operative position, extends across the bath tub and is spaced from the ends of the bath cavity.

43. The bath station as claimed in claim 38, wherein the bath ring assembly is adapted to mount proximate to one end of the bath tub in the ring inoperative position.

44. A small child's bath station comprising:

a) two tub sections that together define a bath cavity, each section having a bottom wall and a side wall with the side wall extending about all but one side of the bottom wall and having a substantially open top, wherein the open tops of the tub sections define a continuous and substantially open top of the bath cavity, and the tub sections are movable to a collapsed and inoperative position and movable in a longitudinal direction to an expanded and operative position; and b) a mechanism associated with at least one of the tub sections being adapted to exert pressure in the longitudinal direction to create a waterproof seal at the bottom wall and the side wall of each tub section and maintain the substantially open top of the bath cavity when the bath station is in its expanded and operative position.

45. The bath station as claimed in claim 44, wherein the mechanism comprises a latching device attached to each tub section for releasably locking the tub sections together in the expanded and operative position.

46. The bath station as claimed in claim 45, wherein the latching device is mounted to one tub section and slidably mounted on the other tub section.

47. The bath station as claimed in claim 44, wherein each tub section comprises a flange mounted on and adapted to extend about the bottom and side wall of each tub section, and wherein the mechanism comprises at least one gasket mounted to at least one flange.

48. The bath station as claimed in claim 47, wherein the at least one gasket is fixably mounted to the at least one flange.

49. The bath station as claimed in claim 47, wherein a first tub section comprises a first flange mounted on and extending about the bottom and side wall of the first section and extending inwardly towards the bath cavity, and wherein a second tub section comprises a second flange mounted on and extending about the bottom and side wall of the second section and extending outwardly away from the bath cavity.

50. The bath station as claimed in claim 44, further comprising a bath ring assembly removably mountable to one of the tub sections in a ring operative position and having a ring inoperative position wherein the bath ring assembly does not obstruct use of the bath cavity.

51. The bath station as claimed in claim 44, wherein at least one tub section comprises at least one flange constructed and adapted to extend about the bottom wall and side wall of at least one tub section.

52. The bath station as claimed in claim 51, wherein the mechanism comprises at least one gasket mounted to at least one flange.

53. The bath station as claimed in claim 52, wherein the gasket is fixably mounted to the at least one flange.

54. A small child's bath station comprising:

a) at least two tub sections, each section having a substantially open top, that together define a bath tub with a bath cavity and having a volume, wherein the bath tub has a bottom wall and a side wall with the side wall extending about all sides of the bottom wall and the open tops of the tub sections define a continuous and substantially open top of the bath cavity; and b) means associated with at least one of the tub sections for releasably locking and compressing at least a portion of the tub sections together in a longitudinal direction so as to form a waterproof seal and maintaining the substantially open top of the bath cavity, and when released enabling the tub sections to collapse together in the longitudinal direction to reduce the volume of the bath tub.

55. The bath station as claimed in claim 54, wherein an open side of each tub section interlocks an open side of another tub section to compressively engage the means for compressing to form the waterproof seal.

56. The bath station as claimed in claim 55, wherein the means for locking and compressing includes a gasket mounted proximate the open side of at least one tub section, wherein the means for locking and compressing includes means for applying a force in the longitudinal direction to the tub sections to expand the tub sections and compress at least a portion of the tub sections toward each other to seal the gasket and form the waterproof seal.

57. A small child's bath station comprising:

a) at least two tub sections that together define a bath tub having a volume, wherein the bath tub has a bottom wall and a side wall with the side wall extending about all sides of the bottom wall;

b) a mechanism associated with at least one of the tub sections being adapted to releasably lock the tub sections together so as to form a waterproof seal and when released is adapted to enable the at least two tub sections to collapse together to reduce the volume of the bath tub; the mechanism including a locking mechanism mounted to at least one mounting bracket, the locking mechanism being adapted to latch at least two tub sections into an operative position and adapted to release at least two tub sections into a storage position, wherein the locking mechanism includes at least one leaf spring attached to a side wall of at least one tub section and a button attached to the leaf spring, wherein the button is adapted to mate and couple with a recess in at least one mounting bracket.

58. A small child's bath station comprising:

a) at least two tub sections that together define a bath tub having a volume, wherein the bath tub has a bottom wall and a side wall with the side wall extending about all sides of the bottom wall;

b) a mechanism associated with at least one of the tub sections being adapted to releasably lock the tub sections together so as to form a waterproof seal and when released is adapted to enable the at least two tub sections to collapse together to reduce the volume of the bath tub; the mechanism including a locking mechanism mounted on a bottom side of the bottom wall and having at least one first abutment mounted to the bottom wall of at least one tub section, the first abutment adapted to engage a second abutment mounted on a separate tub section, and at least one tab is fixably attached to at least one first abutment, wherein the tab is adapted to release the first abutment from engagement with the second abutment.

59. The bath station as claimed in claim 58, wherein the first abutment includes a leaf spring exerting pressure against the first abutment when placed in a locked and operational position.

60. A small child's bath station comprising:

a) at least two tub sections that together define a bath tub with a bath cavity and having a volume, wherein the bath tub has a bottom wall and a side wall with the side wall extending about all sides of the bottom wall;

b) a mechanism associated with at least one of the tub sections being adapted to releasably lock the tub sections together so as to form a waterproof seal and when released is adapted to enable the at least two tub sections to collapse together to reduce the volume of the bath tub; and c) a bath ring assembly mounted on one of the tub sections and moveable between an operative position and an inoperative position, the operative position adapted to support a child in the sitting position within the bath tub and the inoperative position being out of the way so as not to obstruct use of the bath cavity by a child in a reclining position therein, wherein the bath ring assembly includes an arcuate arm removably attached to the side wall of the bath tub and a vertical support attached to the arm.

61. The bath station as claimed in claim 60, wherein the bottom wall of the bath tub is adapted to mate with a bottom of the vertical support in the operative position.

62. The bath station as claimed in claim 60, wherein the bottom wall of the bath tub is adapted to mate with a bottom of the vertical support in the inoperative position.

63. A small child's bath station comprising:

a) at least two tub sections that together define a bath tub with a bath cavity and having a volume, wherein the bath tub has a bottom wall and a side wall with the side wall extending about all sides of the bottom wall;

b) a mechanism associated with at least one of the tub sections being adapted to releasably lock the tub sections together so as to form a waterproof seal and when released is adapted to enable the at least two tub sections to collapse together to reduce the volume of the bath tub; and c) a bath ring assembly mounted on one of the tub sections and moveable between an operative position and an inoperative position, the operative position being adapted to support a child in the sitting position within the bath tub and the inoperative position being out of the way so as not to obstruct use of the bath cavity by a child in a reclining position therein, wherein the bath ring assembly includes at least one ring locking mechanism being adapted to releasably attach the bath ring assembly to the side wall of the bath station, the ring locking mechanism having a connector adapted to fit over a top edge of the side wall of the bath tub.

64. The bath station as claimed in claim 63, wherein the side wall is shaped and adapted to mate with the connector of the ring locking mechanism.

65. The bath station as claimed in claim 63, wherein the bath ring assembly is placed against the side wall when the bath ring assembly is in the inoperative position.

66. A small child's bath station comprising:

a) at least two tub sections that together define a bath tub having a volume, wherein the bath tub has a bottom wall and a side wall with the side wall extending about all sides of the bottom wall;

b) a mechanism associated with at least one of the tub sections being adapted to releasably lock the tub sections together so as to form a waterproof seal and when released is adapted to enable the at least two tub sections to collapse together to reduce the volume of the bath tub; and c) at least one mounting bracket attached to the side wall to slidably couple at least two tub sections.

67. The bath station as claimed in claim 66, wherein the at least one mounting bracket slidably couples at least two tub sections when collapsing or expanding the tub sections into an operative or storage position.

68. A small child's bath station comprising:

a) a bath tub having a bottom wall and a side wall extending about all sides of the bottom wall and forming a bath cavity with two ends; and b) a bath ring assembly moveably mounted in the bath tub between an operative position and an inoperative position, the operative position being adapted to support a child in a sitting position and the inoperative position being adapted to enable a child to recline in the bath tub, wherein the bath ring assembly includes a seat that rests on the bottom of the bath tub and a vertical support attached to the bath ring assembly and that extends upwardly from the seat and is suitable to fit between the legs of a child to further support the child when the bath ring assembly is in the operative position.

* * * * *